US005211376A

United States Patent [19]

Anderson

[11] Patent Number: 5,211,376

[45] Date of Patent: May 18, 1993

[54] MOTORCYCLE JACK

[76] Inventor: Donald J. Anderson, P.O. Box 30996, Lafayette, La. 70503

[21] Appl. No.: 508,823

[22] Filed: Apr. 13, 1990

[51] Int. Cl.[5] ..... B66F 5/04

[52] U.S. Cl. ..... 254/134

[58] Field of Search ..... 211/17, 22; 254/88, 254/90–91, 131, 133, 134; 248/351, 352; 280/293; 414/447

[56] References Cited

U.S. PATENT DOCUMENTS

| | | | |
|---|---|---|---|
| 431,740 | 7/1890 | Curtis | 211/22 |
| 2,803,349 | 8/1957 | Talbot | 211/22 |
| 2,805,860 | 9/1957 | Littig | 211/22 |
| 4,077,607 | 3/1978 | Lovelady | 254/88 |
| 4,193,582 | 3/1980 | Nellson | 254/131 |
| 4,348,010 | 9/1982 | Baxter | 254/131 |
| 4,723,756 | 2/1988 | Stumpf | 254/134 |

*Primary Examiner*—Robert C. Watson

[57] ABSTRACT

A motorcycle jack assembly comprising a wheel support frame having tire alignment members and tie down means to fix one wheel of the motorcycle in the wheel support frame, and further comprising an alignment frame attached to the wheel support frame and positioned to cause the motorcycle body to remain parallel with the wheel fixed in the wheel support frame when the motorcycle body is supported by a jack attached to the alignment frame.

6 Claims, 1 Drawing Sheet

MOTORCYCLE JACK

BACKGROUND OF THE INVENTION

1. Field of the Invention.

This invention relates in general to devices for vehicle jacks, and more particularly to motorcycle jack assemblies.

2. Prior Art.

In many repairs of a motorcycle it is desirable, if not necessary, to position at least part of the motorcycle off the ground so that the repair person can more easily repair the motorcycle. Two major problems have been encountered in past attempts to design and construct a motorcycle jack assembly to support at least part of the motorcycle in a raised position. The first has been the difficulty once the motorcycle has been jacked up in preventing the motorcycle wheels from moving during the repair operation on the motorcycle. The second major problem has been the slippage of the jack assembly during the repair operation. Either of these problems can cause the entire motorcycle to fall from the jack assembly damaging the motorcycle or even injuring the person repairing the motorcycle.

Examples of various jack or stand assemblies designed for use with motorcycles are illustrated in the following patents U.S. Pat. No. 4,180,253 issued to Michael S. Ivers et al on Dec. 25, 1979 and entitled "Support for a Motorcycle"; U.S. Pat. No. 4,420,164 issued to Mark T. Mitchell on Dec. 13, 1983 and entitled "Stand for Dirt Bike"; and U.S. Pat. No. 4,681,299 issued to Louis P. Siebert on July 21, 1987 and entitled "Motorcycle Jack". In addition typical jack assemblies now commercially available would include: the Cycle Jack manufactured by the Lincoln Manufacturing Company, Inc. and advertised in the February 1990 Road Rider magazine at page 6. However, none of these satisfactory overcome the prior art difficulties without utilization of complex, expensive structural designs.

SUMMARY OF THE INVENTION

Therefore, it is an object of this invention to provide a motorcycle jack assembly that can support a motorcycle in a raised position.

Another object of this invention is to provide a motorcycle jack assembly that can prevent one of the motorcycle wheels from moving once the motorcycle has been positioned in a raised position.

Still another object of this invention is to provide a motorcycle jack assembly that can prevent slippage of the jack used to raise the motorcycle.

A further object of this invention is to provide a relatively inexpensive motorcycle jack assembly that not only prevents one of the motorcycle wheels from moving once the motorcycle has been positioned in a raised position, but also eliminates the possible slippage of the jack during operation.

These and other objects and advantages of the invention shall become apparent from the ensuing descriptions of the invention.

Accordingly, a jack assembly for use on motorcycles and similar vehicles is provided which comprises (a) a wheel support frame comprising (i) elongated members perpendicularly attached to one another to form a stable base member, (ii) parallel tire alignment members fixedly attached to the base member, two of the tire alignment members being separated a distance greater than the width of the wheels of the motorcycle and positioned to allow one of the motorcycle wheels to pass between them, and (iii) means to attach that end of the motorcycle that is positioned over the wheel support frame to the wheel support frame; (b) a motorcycle alignment frame comprising (i) a jack support plate, and (ii) frame members each attached at one end to one of the tire alignment members and extending away from the wheel support frame in a direction parallel with the tire alignment members, and each attached at its opposite end to the jack support plate; and (c) a jack attached to the jack support plate in a position to operatively contact the motorcycle to raise at least a portion of the motorcycle from the ground.

BRIEF DESCRIPTION OF THE DRAWINGS

FIG. 3 is a fragmentary view of the motorcycle stand mechanism.

PREFERRED EMBODIMENTS OF THE INVENTION

Figures 1, 2:
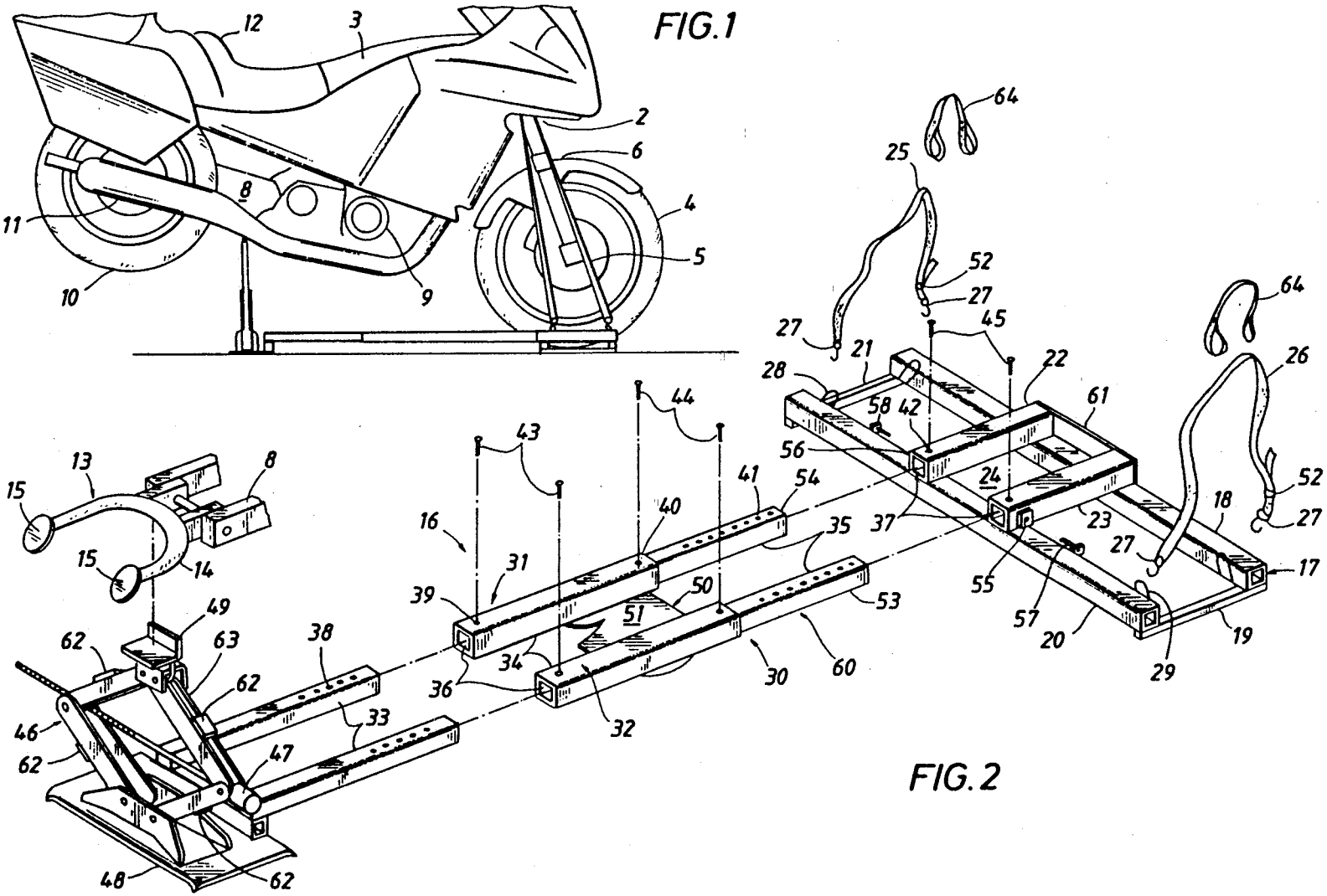
FIG. 1 is a side view of a preferred embodiment of the invention with a motorcycle positioned on the jack assembly
FIG. 2 is an exploded view of a preferred embodiment of the invention.

Referring now to the Figures, one preferred embodiment of the invention is shown wherein a motorcycle 1 can be mounted on jack assembly 16 which in its broadest concept comprises a wheel support frame, a motorcycle alignment frame and a jack.

In a typical configuration motorcycle 1 is constructed having a front steering assembly 2 and rider support frame assembly 3. The steering assembly 2 comprises a front wheel 4 mounted on an axle 5 which in turn is operatively mounted to steering frame 6, referred to as a lower tree. Handle bars 7 are mounted to the top end of steering frame 6 in a manner that causes front wheel 4 to turn when handle bars 7 are turned. The lower tree is pivotally attached to the rider support frame assembly 3. The rider support frame assembly 3 comprises a rigid frame structure 8 to which a motor 9 is fixed and operatively connected to a rear wheel 10 to cause the rear wheel to rotate about the rear axle 11 to which it is connected. In addition frame structure 8 will be provided with a seat 12 on which the rider can sit. Because of its structure motorcycle 1 can not stand upright by itself, and must be provided with a center stand assembly 13 which is attached to the bottom part of frame structure 8. Center stand assembly 13 is provided with a center stand member 14 having spread apart foot members 15 which can pivot downward from frame structure 8 and contact the ground. In this manner motorcycle 1 can be stood upright when not being operated, but is still not very stable as only a small push will cause it to fall onto its side.

As more clearly shown in FIG. 2 jack assembly 16 comprises wheel support assembly 17 that in a preferred embodiment consists of four elongated members 18–21 fixed to one another, preferably at their ends, to form a stable rectangular base member. In addition wheel support assembly 17 consists of parallel tire alignment members 22 and 23 attached to the top surface of members 18 and 20 so that in conjunction with the ground they form a cavity 24 into which front wheel 4 or rear wheel 10 can be positioned. It is preferred that members 18–23 be assembled in a manner that will provide vertical support for the front wheel 4 when it is operatively positioned on the wheel support assembly 17 so as to reduce or eliminate any vertical or rotational movement of front wheel 4.

In a particularly preferred embodiment opposite members 18 and 20 will be on top of opposite end members 19 and 21 so as to raise them above the ground. Thus when parallel tire alignment members 22 and 23 are attached to the top surface of members 18 and 20 a deeper cavity 24 will be formed into which front wheel 4 will fit. In the preferred embodiment member 18–23 will be constructed from tubular members having a square or rectangular cross-section in order to provide additional stability to wheel support assembly 17. In the illustrated embodiment members 18 and 20 will be separated by a distance that will barely allow the bottom of front wheel 4 to contact the ground when it is positioned in cavity 24, and most preferably they will be separated a distance whereby front wheel 4 will contact both members 18 and 20 when it is positioned in cavity 24. The members 18 and 20 will extend out beyond either side of motorcycle 1 when it is positioned on jack assembly 16.

Wheel support assembly 17 also consists of means attachable to the lower tree and to the outwardly extended portions of members 18–21 to provide additional assurance that motorcycle 1 will not fall on its side once is it secured to the jack assembly 16. One preferred means comprises tie down straps 25 and 26. Each strap will be provided with S-hooks 27 attached to each end of the strap that can quickly clip onto eyelet members 28 and 29 attached to the end portions of members 18 and 20 as shown in FIG. 2.

Motorcycle alignment frame 30 comprises frame members 31 and 32 which are attached to wheel support assembly 17 and extend outward therefrom in a direction, preferably parallel to tire alignment members 22 and 23, which provides stabilizing support to 13 the wheel support assembly. In the embodiment shown, each frame member 31 and 32 will be multi-sectioned and shaped to telescope into one another. One preferred embodiment of this arrangement is illustrated in FIG. 2. Each frame member consists of three sections 33, 34 and 35 wherein outer sections 33 and 35 have a cross-sectional shape and size to slide into and out of the hollow passageway 36 of sections 34. The sections 35 will also slide into and out of hollow passageways 37 of tire alignment members 22 and 23. In this embodiment sections 33 and 34 will each be provided with a series of openings 38 and 41, respectively, that can be aligned with openings 39 and 40 of section 34, and openings 42 of tire alignment members 22 and 23, so that locking pins 43–45 can be inserted through the aligned openings 38–42 to fix the length of frame members 31 and 32, and to attach sections 35 to tire alignment members 22 and 23. The series of openings 38 and 41 allows for adjustment to the length of frame members 31 and 32.

In an alternate preferred embodiment frame members sections 34 and 35 can be formed as single pieces 59 and 60 wherein their ends 53 and 54, respectively, are shaped to slidingly fit into passageways 37'. In this embodiment tire alignment members 22' and 23' each have a threaded opening 55 and 56, respectively which connects with one of the passageways 37' so that set screws 57 and 58, respectively, can be tightened down on ends 53 and 54 when they are inserted into passageways 37. It has been found that in most cases only one set screw needs to utilized.

Jack 46 is positioned at the extended end 47 of sections 33 so that when sections 35 are inserted in passageway 37 jack 46 will be aligned with cavity 24. In one embodiment jack 46 will be rigidly attached in suitable manner to a jack support plate 48 which is fixed to ends 47 of sections 33. In this latter embodiment a complete rigid, stable jack assembly is provided.

Jack 46 can be a conventional scissors jack. If desired reinforcement strips 62 can be welded to jack legs 63. It is preferred that a frame adapter 49 be affixed atop jack 46 that is shaped to engage the center of stand 14. Also if desired the jack 46 can operated by motor, rather than manually. It is preferred that adapter 49 be L-shaped so as to engage all models of motorcycles.

As another preferred feature, tire stop 61 is affixed between tire alignment members 22 and 23.

In the preferred embodiment ramp 50 is provided that fits between frame members 31 and 32, and has an upwardly sloped surface 51 that extends to the top edge of member 20 in order to assist in positioning the motorcycle wheel in the cavity 24.

In operation motorcycle 1 is positioned between frame members 31 and 32, and then the front wheel is pushed up ramp surface 51 until its lower portion drops into cavity 24. Once in that position tie down straps are wrapped around steering frame 6 or other part of steering assembly 2 and clipped to eyelet members 28 and 29. The straps 25 and 26 are provided with conventional means 52 to cinch the straps tightly against steering frame 6. Alternatively straps 25 and 26 could be constructed from elastic material and their length predetermined so that when wrapped around steering frame 6 and clipped to eyelet members 28 and 29 they would be pressed tightly against steering frame 6.

With the motorcycle front steering assembly 2 and wheel 4 secured to the wheel support assembly 17, motorcycle alignment frame is adjusted in length so that jack support plate 48 is positioned directly below the center stand 14 when jack 46 is scissored up. Of course a portion of the rear wheel 10 can be engaged in the cavity 24, and the tie-down straps used to secure the rear of the bike to the eyes 28, 29. Then the jack 46 and support plate 48 are positioned by adjustment below the frame of the motorcycle 1 under the engine 9, and the jack operated to raise the front wheel 4 off the ground in case repairs are needed at the front portion of the motorcycle. With the arrangement shown in FIG. 1, the straps 25, 26 will be tightened as the rear of the bike is raised, due to the rake angle of the front fork assembly 6.

There are of course many other embodiments of the invention and it is intended that they be included within the scope of the invention as described and claimed herein.

What I claim is:

1. A jack assembly for use in raising one of the front and rear wheels of a two-wheeled vehicle such as a motorcycle off the ground to facilitate repairs, comprising: a generally T-shaped frame having a transverse portion and a longitudinal portion, said transverse portion being adapted to be located below that wheel of the vehicle that is opposite to the wheel being raised, said longitudinal portion extending away from said transverse portion for a distance that is substantially less than the distance between the axles of such front and rear wheels; wheel receiver means on said transverse portion for restraining forward, rearward and lateral movement of a wheel engaged therewith; means to hold down the wheel that is engaged with said receiver means; and base means on the end of said longitudinal portion opposite said transverse portion and adapted to support a jack by which that portion of a vehicle located above said base means can be jacked upward with respect to said longitudinal portion while said transverse portion and said hold down means maintain the vehicle in an upright position.

2. The assembly of claim 1 further including jack means attached to said base means and positioned thereon in a manner to engage the frame of the vehicle.

3. The assembly of claim 1 wherein said longitudinal portion of said frame includes spaced-apart, parallel tubular member adapted to telescope in order to provide adjustment of the length of said longitudinal portion.

4. The assembly of claim 3 wherein said transverse portion includes spaced-apart, parallel tubular members adapted to provide lateral stability.

5. The assembly of claim 4 wherein said longitudinal portion includes a pair of front members that are fixed to said tubular members of said transverse portion in a manner such that the rectangular area therebetween provides said receiver means against tip-over.

6. The assembly of claim 5 further including ramp means between said tubular members of said longitudinal portion adjacent said transverse portion for facilitating placement of a portion of a wheel of the vehicle in said receiver means.

* * * * *